United States Patent [19]

Martinez

[11] 4,108,391

[45] Aug. 22, 1978

[54] FEEDING SYSTEM FOR MANUFACTURING MACHINES CONSUMING PAPER SUPPLIED IN A CONTINUOUS STRIP

[76] Inventor: D. Manuel Torres Martinez, Sancho El Fuerte, 21 Pamplona, Spain

[21] Appl. No.: 755,145

[22] Filed: Dec. 29, 1976

[30] Foreign Application Priority Data

Feb. 20, 1976 [ES] Spain ..... 218.966[U]
Oct. 16, 1976 [ES] Spain ..... 223.836[U]

[51] Int. Cl.[2] ..... B65H 19/14
[52] U.S. Cl. ..... 242/58.3; 156/505
[58] Field of Search ..... 242/58.3, 58.1, 58.2, 242/58.4, 58.5, 58.6; 156/504, 505, 502, 506

[56] References Cited

U.S. PATENT DOCUMENTS

| | | | |
|---|---|---|---|
| 2,613,042 | 10/1952 | Dice | 156/504 X |
| 2,664,139 | 12/1953 | Speed | 156/505 |
| 3,841,944 | 10/1974 | Harris | 156/504 |
| 3,925,131 | 12/1975 | Krause | 242/58.3 |
| 3,971,524 | 7/1976 | Nudinger | 156/504 |

*Primary Examiner*—Edward J. McCarthy
*Attorney, Agent, or Firm*—Eyre, Mann, Lucas & Just

[57] ABSTRACT

A feeding system for manufacturing machines consuming paper supplied in a continuous strip employs a holding and joining device for holding the leading edge of a reserve strip in a buckle concave to a cutting knife. The reserve strip is contacted with the strip being supplied and the cutting knife severs the strip being supplied by passing therethrough. The reserve strip remains unsevered because the knife travels in the buckle.

8 Claims, 4 Drawing Figures

FEEDING SYSTEM FOR MANUFACTURING MACHINES CONSUMING PAPER SUPPLIED IN A CONTINUOUS STRIP

The present invention refers to a reel joining mechanism of the type used in feeding paper to manufacturing machines for making the join and change over of reels when the supply from the one being dispensed is exhausted, and such reel joining mechanism has been substantially improved upon with respect to those which up to now have been in use, insofar as it achieves very much more advantageous features which render it preferable for the purpose of making joins, and particularly so in the case of automatic joining for the supply of strip in a continuous process.

This reel joining mechanism which is covered by the invention is provided with a rotating reel holder arranged to support at the same time both the reel which is being expended as well as the new one to be joined when the former becomes exhausted, and on the top it has equipment comprised of a set of rollers, shearing means, and means for holding and for joining the paper, and this equipment guides the paper during the supplying process, while at the time when the reels are being changed over, it automatically joins the paper from the reel which is exhausted to that on the new one, and then goes on guiding the paper from the latter so as to achieve an uninterrupted supply.

A paper storage unit, comprised of a forward roller and a rear travelling roller, over which two the strip of paper runs, ensures the supply is made in a continuous and uniform process, even during the time when the reels are being changed over, which it does by means of displacement of the rear travelling roller in the direction the supply is being made, whilst the reels are being changed over, so as to pay out the paper held in store during the time when the new reel is running up to the speed of the supply; and for this purpose the travelling roller is attached to a carrying chain, with the peculiarity moreover that the unit is provided with means to ensure that the paper is supplied at the constant preset tension, and overcomes any accidental variations in the tension as may arise occasionally, for which purpose too the forward roller is mounted in a floating fashion in constant balance between the pull being exerted by the paper and the thrust from a set of pneumatic cylinders, and it moves whenever there is a change in the tension so as to restore the balance at all times.

Moreover, the equipment for holding and joining the paper is comprised of a rocking arm, upon whose end, and similarly below a guide for carrying the shearing means, there is a groove designed to accommodate a buckle in the paper in readiness for joining, so that when the rocking arm presses this paper to be joined against that belonging to the strip being supplied in order for them both to become stuck together and in order for the shearing means to stop and remove the excess paper from the reel which is expended, then the new strip of paper is not affected by the shear; and said rocking arm is provided with means to hold the paper to be joined until the join is made, and which means may comprise a set of pressure applying cylinders arranged at one side of said groove, or alternatively they may comprise a vacuum chamber with small openings on the upper surface for the purpose of holding the paper by suction.

Moreover, in order for the said rocking arm to be able to press automatically upon the strips of paper while they are being joined, and to release them automatically again after joining is completed, the shaft about which said arm rocks is linked to a double pneumatic cylinder, which acts both as a torque cylinder and as an impact cylinder, so that upon being moved automatically by the cylinder, the rocking arm may assume any one of three positions, these being the upper or joining position, the intermediate or stand-by position, and the lower position where it makes ready the paper to be joined, and it travels from one position to another at a predetermined speed set at whatever rate is most suitable for each stage in the procedure.

This therefore is a highly advantageous method for joining paper, since it maintains the strip in constant tension throughout the whole supply, taking the actual fluctuations in the tension of the paper as reference for this purpose; and because it operates on the basis of a double and combined action, whereby the paper is either paid out or pulled in, and in this way there is no way in which effects giving false results can act upon the system, while it becomes possible to eliminate completely all causes which give rise to fluctuations.

The joining procedure can similarly be carried out with a high degree of effectiveness and efficiency, with avoidance of all possible failures in the joining and cutting stage, since the arrangement allows for perfect motionlessness of the paper while the join is being made, with no sudden jerking, and it ensures complete safety of the new strip of paper being joined from the effect of the shearing means, since this operates in order to remove the unwanted paper form the strip belonging to the reel which is exhausted; and in consequence this system is very reliable and sensitive in operation, while moreover it is simpler and more straightforward than other conventional ones, which furthermore are based upon principles which do not allow for such perfect operation.

Figure 1:
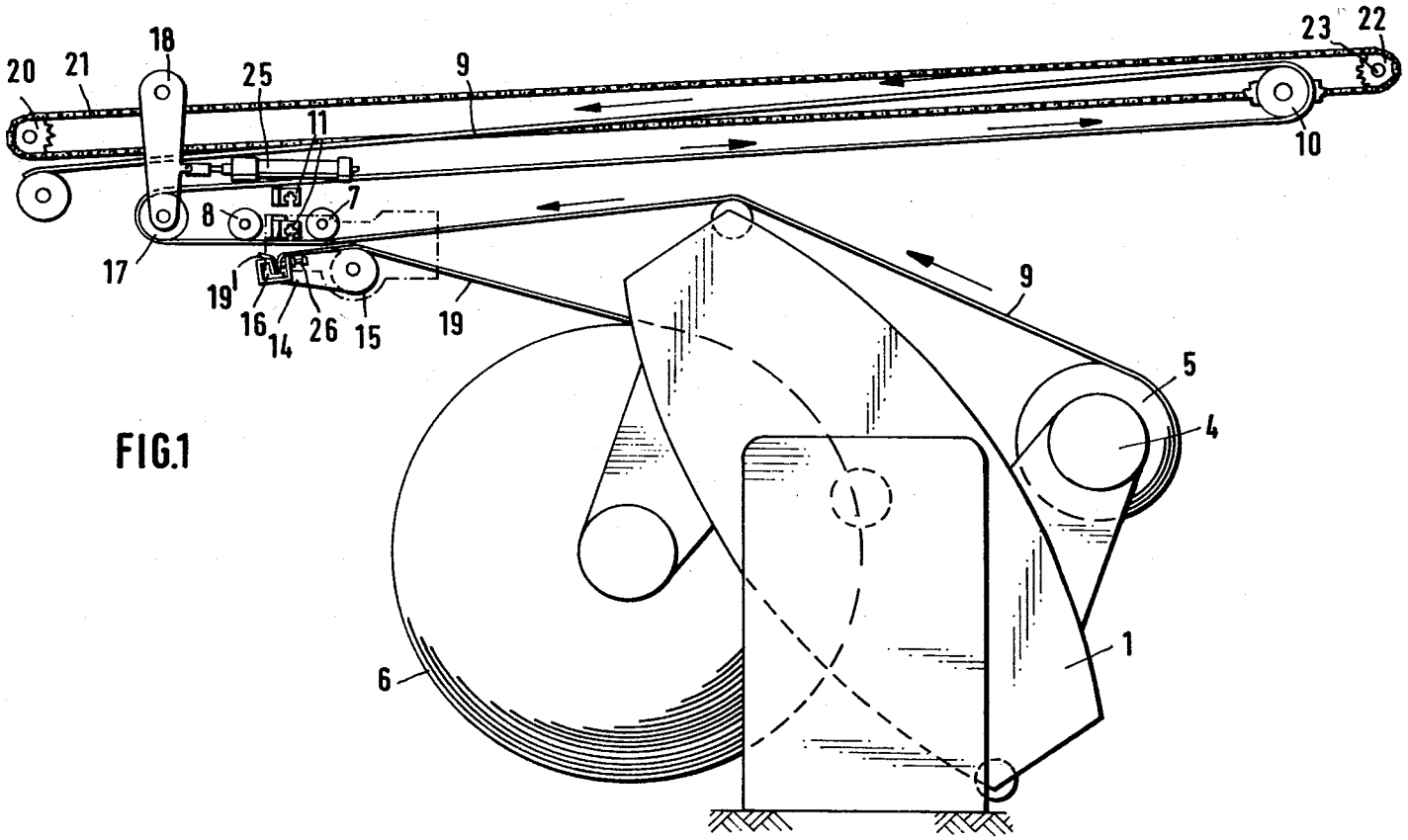
FIG. 1 depicts a schematic arrangement of the joining device which is being dealt with here.

In accordance with the invention, and as depicted in the illustrations given, in a position above the said reel holder 1, there is a set of rollers, comprised of two rollers 7 and 8 to guide the strip of paper 9 being supplied, a roller 17 capable of swivelling due to its being suspended from two webs 18, which are thrust by two cylinders 25, and a further travelling roller 10, over which paper 9 returns, and which comprises a paper store to ensure the supply of paper in a continuous and even process, where this roller 10 is normally in the withdrawn position as shown on the right hand side where it is depicted in FIG. 1.

Figure 2:
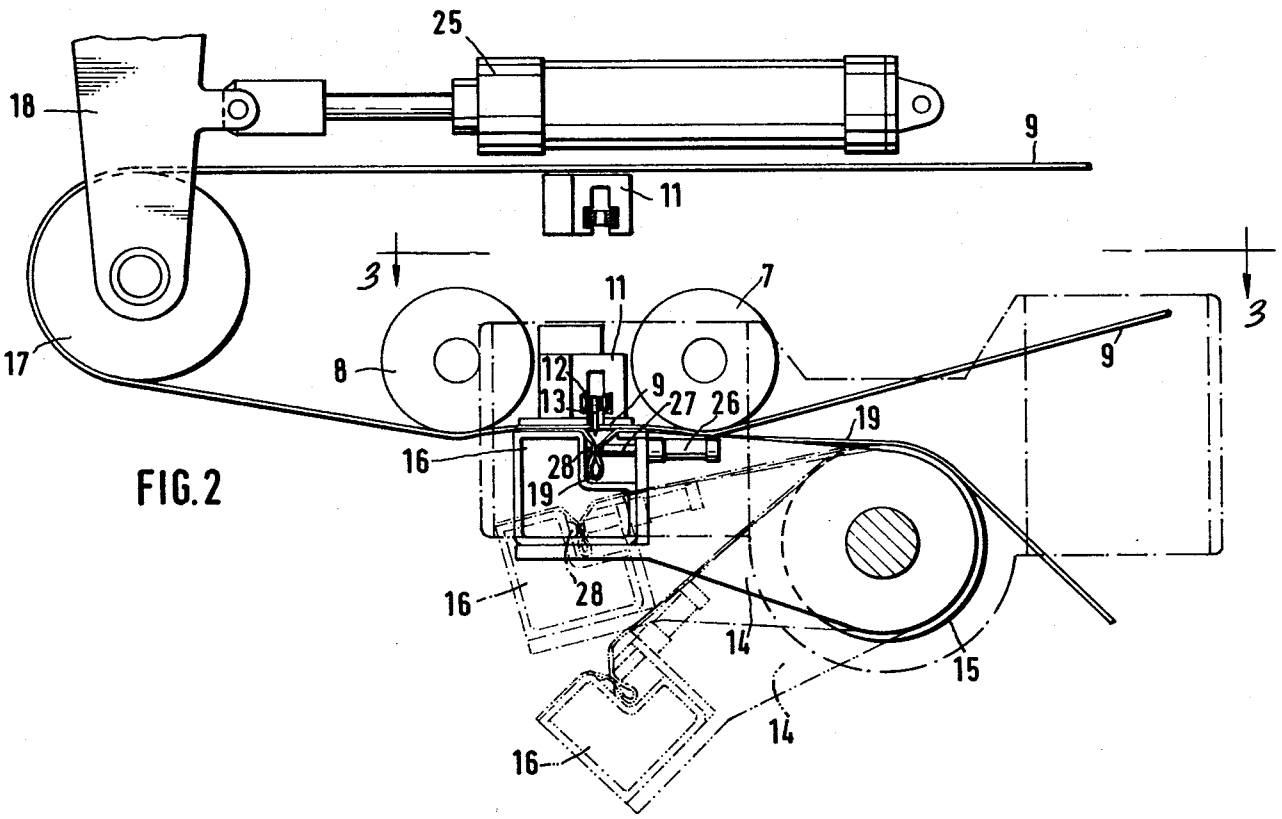
FIG. 2 shows a detailed view of the joining mechanism itself, with the end of the rocking member shown in section.

Between guide rollers 7 and 8 there are interposed guides 11, upon which their slides a chain 12, FIG. 2, carrying a blade 13 for shearing the unwanted paper from the supply reel 5 when this becomes exhausted, and after the join of the new reel has been made.

The joining unit itself comprises a member 14, which is pivot mounted on the shaft belonging to roller 15, and upon whose opposite end there is a device 16 which engages longitudinally with guides 11 when the member 14 is pivoted towards them, so that the groove on the lower guide 11 conicides with the groove on device 16. The device 16 is comprised of a section having a channel along its top, while on one of the sides there are several pneumatic cylinders 26, whose purpose is to grip the beginning of the paper from the new reel, and to make it form into a fold upon the paper becoming held by plungers 27 against stops 28. See FIG. 2.

Paper 19 from reel 6 to be joined, goes over roller 15 and member 14, and is gripped against device 16 due to the thrust from cylinders 26, and upon the paper 19 being sheared off at the front and flush with device 16, a strip of adhesive paper 19' is placed across its end, see FIG. 1, and the join is in this way made ready.

Then, when supply reel 5 becomes exhausted, member 14 revolves until it grips the strip being supplied 9 against the lower guide 11, whereupon the strip is held motionless, while at the same time paper 19 from the new reel 6 is stuck to it, and at this same moment chain 12 begins to move, so that blade 13 effects a stroke to shear off excess paper 9, but without reaching paper 19, since this latter, upon being accommodated in the groove in the device 16, is outside the range of the blade 13.

While this joining operation is being carried out, there is no interruption in the paper feed, because at exactly the same time when strip 9 becomes gripped between device 16 and the lower guide 11, roller 10 begins to travel forwards paying out paper by means of shortening the length of the loop of the paper over the roller 10.

Once shearing has been accomplished, roller 10 returns to its initial withdrawn position, and paper 19 is released from device 16, due to the fact that when the device 16 comes into contact with guides 11, cylinders 26 cease to actuate, and their plungers 27 are withdrawn to their initial positions, so that the end of paper 19 is now stuck to paper 9, and free from the grippng action imposed upon it by device 16. As soon as blade 13 has sheared off paper 9, member 14 descends to its intermediate position, so that paper 19 is left free to enable reel 6 to commence running up to speed.

Acceleration of reel of paper 6 after the join has been completed, is achieved because of roller 10, which is displaced by the pull from the paper 9 when this latter becomes motionless upon being gripped, and because of roller 10, which is joined by its ends to a chain 21 mounted on pinions 20 and 22, so that during the travel of the rollers 10 due to its being displaced by the pull exerted by paper 9, there is a progressive increase in the resistance to the displacement, and when paper 9 ceases to be held motionless on guides 11 due to the action of member 14, all the resisting force which opposes roller 10 upon being displaced by the pull on paper 9, is transmitted to reel 6.

The progressive increase in the resistance to the displacement of roller 10 due to the pull exerted by paper 9, is achieved due to the fact that upon any of the shafts holding pinions 20 and 22, in this case it is on shaft 23—see FIG. 1—a tension adjusting device is connected which can be electric, pneumatic or of any other type, so that it is when roller 10 is in the position where it is shown in FIG. 1, that the maximum amount of paper is accumulated, and in such position, the tension adjusting device exerts the minimum preset tension, whereas when the roller is drawn along its travel by the pull from the paper, shaft 23 transmits its rotation to the tension adjusting device which gradually increases the tension, and this increase in tension is transmitted through a sliding clutch arranged on one end of shaft 23, thus allowing there to be a progressive increase without any jerking in the acceleration of the new reel which is joined.

Once the new reel 6 has accelerated up to speed, reel holder 1 is made to revolve, and reel 6 travels across to the position of reel 5, so that the spindle which held 5 is left free for a further reel to be placed upon it.

In a particular construction, and in order for there to be a greater facility for paper 19 to adapt itself to the groove on the device 16, an additional travelling member may be incorporated for the purpose of assisting the entry of paper strip 19 into said groove, by a pushing motion.

Member 14 has three fixed positions, as may be appreciated from FIG. 2.

It has the upper position, which is the one it adopts for the joining operation.

It has the middle position, which is the one it adopts for stand-by while waiting to commence the joining operation.

And it has the lower position, which is the one it adopts for making ready the commencement of the strip from the new reel.

Figure 3:
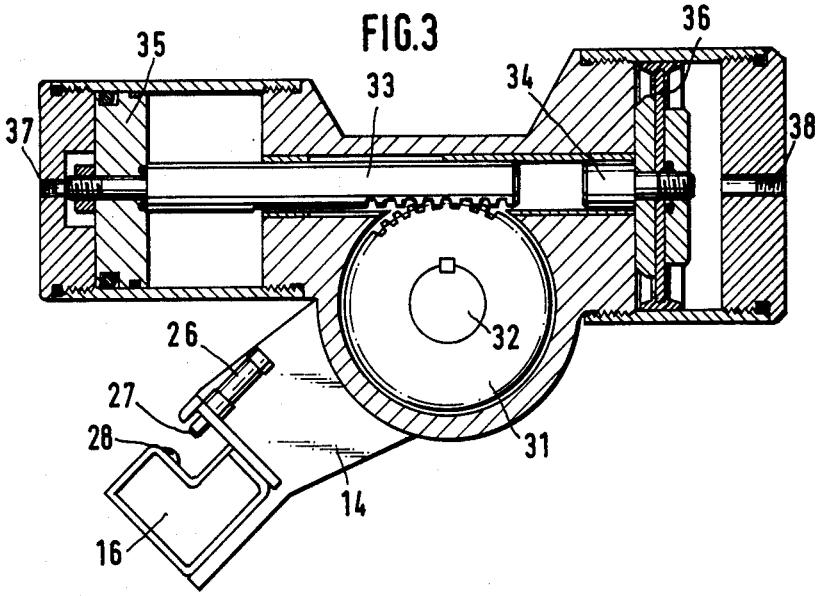
FIG. 3 depicts a sectional view taken along 3—3 of FIG. 2 of the device for operating the arms which hold the device which holds the end of the paper that it is wished to join.

Positioning of member 14 in one or another of above positions is achieved by means of a pneumatic cylinder—see FIG. 3 —which has the combined features of a torque cylinder, all in a single unit that has been specially designed for these purposes.

It works in the following manner:

Member 14 is fitted onto shaft 32, and on one end of the shaft is pinion 31 which engages with plunger 33 with a toothed rack machined on it towards its free end, and then, when piston 35 has no pressure being applied to it through inlet 37, member 14 descends by gravity to its lower position, which is the one it adopts for making ready the commencement of the strip from the new reel.

Once the paper has been made ready with member 14 in the lower position, air is made to enter through inlet hole 37 and piston 35 is displaced slowly, since hole 37 is fitted wth a flow regulator, by means of which adjustment can be made as to the speed of displacement of member 14 from the lower position to the intermediate position.

Whilst member 14 is moving towards the intermediate position, there is pressure at hole 38, and piston 36 remains at the position in which it is shown in FIG. 3, so that when piston 35 moves, plunger 33 comes into contact with plunger 34, and is held in this position because piston 36 has a greater diameter than piston 35, and therefore exerts more force when operating at the same pressure, thus bringing member 14 to its intermediate position.

When member 14 travels from the intermediate to the upper position, it is necessary for it to do so very quickly and forcibly in order for the paper to be brought to rest rapidly. Such extremely fast travel of member 14 is achieved by means of exhausting the air holding piston 36 very quickly through a quick outlet, thus allowing piston 35 to travel at high speed, since it is at rest in a position equivalent to a very high proportion of its total stroke, so that the large chamber of air acting on the face of the piston makes it operate as an impact cylinder when the air holding piston 36 is rapidly exhausted.

It must in any case be noted that the joining mechanism in question here is capable of being adapted to any existing model of rotating reel holders.

Figure 4:
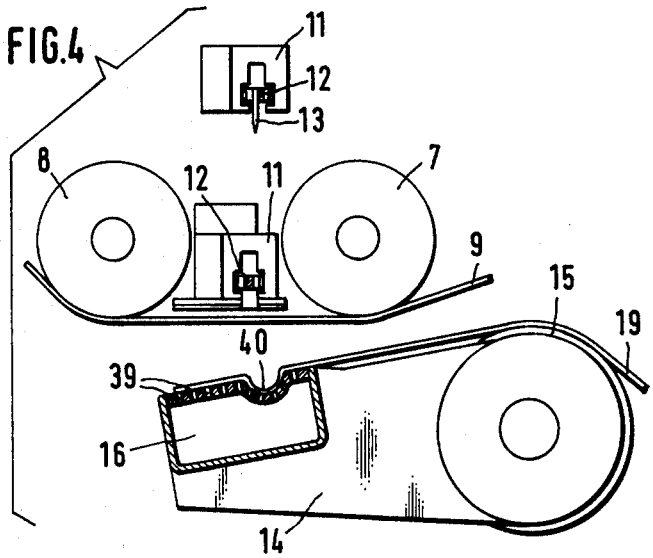
FIG. 4 is a detailed view of the joining device itself, in the version where a vacuum chamber is provided for the purpose of gripping the paper to be joined.

The foregoing description covers a mode of construction which is capable of having alterations incorporated into it, such as is the case of the joining mechanism 14 as is illustrated in FIG. 4 on the drawings, where this unit can be constructed without pneumatic cylinders 26, and provided instead with a chamber inside the end device 16 which in its wall that faces guides 11, has a series of holes 39, and which wall defines also the groove 40 required to save the paper strip from the path of the blade when shearing off the unwanted length. The chamber in device 16 is equipped with a suction mechanism (not shown), which creates a vacuum inside said chamber, thus giving rise to suction through holes 39, which causes the end of paper 19 to be held motionless, and to adapt itself to the shape of groove 40, thus achieving a similar effect to that which was obtained by means of cylinders 26 in the other version of the embodiment as was described at the beginning.

I claim:

1. In a feeding system for manufacturing machines consuming paper supplied in a continuous strip having a first roller for holding a supply reel of paper, a second roller for holding a reserve reel of paper, means for guiding and feeding the strip from said supply reel to said manufacturing machines, means for joining the leading edge of the paper on said reserve reel to the strip from the supply reel, cutting means for cutting the strip from the supply reel whereby the reserve reel is substituted for the supply reel, the improvement comprising:

(a) means for holding a transverse strip of said strip from the reserve reel;

(b) said means for holding having means for forming a buckle completely across said transverse strip said buckle being concave toward the strip from the supply reel;

(c) contacting means for contacting the end of said strip from the reserve reel with the strip being supplied from the supply reel;

(d) contact adhesive means for adhering the end of said strip from the reserve reel to the strip from the supply reel; and (e) said cutting means being operative to cut completely through the strip from the supply reel in a transverse location aligned with said buckle whereby the cutting means does not touch the strip from the reserve reel.

2. Apparatus recited in claim 1 further comprising:

(a) said means for holding containing a transverse groove therein;

(b) said groove aligned with said means for cutting; and (c) means for securing said transverse strip in said groove whereby said buckle is formed.

3. Apparatus recited in claim 2 wherein said means for securing comprises at least one fluid pressure actuated member, said fluid pressure actuated member having a plunger protruding into said groove and operative to grip a transverse fold of the strip from said reserve reel.

4. Apparatus recited in claim 2 wherein said means for securing comprises vacuum means in said groove operative to draw said transverse strip into said groove thereby forming said buckle.

5. Apparatus recited in claim 1 furher comprising means for reversing the position of the first and second rollers after the joining operation is completed.

6. A feeding system for manufacturing machines consuming paper supplied in a continuous strip, in full accordance with claim 1, further comprising a rocking joining member, the shaft for the rocking joining member is linked to a double pneumatically operated cylinder, which is comprised of two chambers, where one has a greater diameter than the other, and where each houses its respective piston, these being provided with their plungers which face one another, and where the plunger belonging to the larger diameter piston has a toothed rack machined on its end, to engage with a pinion attached angularly to said shaft for the rocking joining member, so that the inlet and opening of the exhaust for fluid in both chambers in the cylinder, in conjunction with the difference in the thrust exerted by the two pistons for a given fluid pressure, cause there to be a sequence of variable displacements of the plunger with the rack machined on it, which makes the rocking member assume its upper, intermediate or bottom position, with a quick or slow change from one to another, in accordance with what is required in each case.

7. A feeding system for manufacturing machines consuming paper supplied in a continuous strip, in full accordance with all that is stated under claim 1, further comprising the storage unit for the paper being supplied is comprised of a stationary forward roller and a further travelling rear roller, of which the former is mounted in a floating fashion in constant balance between the effect of the pull exerted by the paper and the thrust from a set of constant acting pneumatic cylinders, where it moves forwards and backwards as the result of variations in the tension on the paper, and any possible differences in tension between one edge of the paper and the other, whereas the rear travelling roller is attached to a chain which is mounted between two shafts extending longitudinally from the paper joining assembly, and where the shaft which operates said chain actuates progressively when said shaft revolves and the travelling roller advances in consequence; all in such a way as to achieve an even tension throughout the whole of the strip of paper, and to make the paper be paid out from the storage unit in accordance with the rate of acceleration of the new reel after being joined.

8. A feeding system for manufacturing machines consuming paper supplied in a continuous strip, in full accordance with claim 4, further comprising a rocking joining member, the rocking joining member terminates in a chamber whose upper wall defines the said groove required to prevent the paper from coming into the range of the shearing means and which chamber has a number of small openings in its upper wall, whereas its inside is connected to or contains means of suction, so that in this case the end of the strip of paper to be joined is held motionless by the said suction, and is at the same time adapted to the shape of the groove in which it is accommodated, in order to remain outside the range of the shearing means during the joining operation.

* * * * *